US011821430B2

(12) United States Patent
Hu et al.

(10) Patent No.: US 11,821,430 B2
(45) Date of Patent: Nov. 21, 2023

(54) OIL TRANSPORT STRUCTURE IN AN ELECTRIC MOTOR OF AN ELECTRIC SUBMERSIBLE PUMP (ESP) ASSEMBLY

(71) Applicant: Halliburton Energy Services, Inc., Houston, TX (US)

(72) Inventors: Yuzhu Hu, Houston, TX (US); Dezhi Zheng, Houston, TX (US); Yu Dong Sun, Tianjin (CN); Donn J. Brown, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/529,065

(22) Filed: Nov. 17, 2021

(65) Prior Publication Data

US 2023/0151816 A1 May 18, 2023

(51) Int. Cl.
*F04D 13/08* (2006.01)
*F04D 29/58* (2006.01)
*F04D 13/10* (2006.01)

(52) U.S. Cl.
CPC ..... *F04D 13/086* (2013.01); *F04D 13/10* (2013.01); *F04D 29/5806* (2013.01); *F04D 29/5886* (2013.01)

(58) Field of Classification Search
CPC ..... F04D 13/086; F04D 1029/047; F04D 1029/048; F04D 1029/049;
(Continued)

(56) References Cited

U.S. PATENT DOCUMENTS 3,671,786 A * 6/1972 Jones ..... F04D 13/083 310/87
2010/0329908 A1 12/2010 Martinez et al.
(Continued)

FOREIGN PATENT DOCUMENTS

CN 203285712 U 11/2013
GB 2315608 A * 2/1998 ..... F16N 7/366
(Continued)

OTHER PUBLICATIONS

Foreign Communication from Related Application—International Search Report and Written Opinion of the International Searching Authority, International Application No. PCT/US2022/045537, dated Jan. 26, 2023, 12 pages.

*Primary Examiner* — Kenneth J Hansen
(74) *Attorney, Agent, or Firm* — Conley Rose, P.C.; Rodney B. Carroll

(57) ABSTRACT

An electric submersible pump (ESP) assembly comprises a centrifugal pump assembly, a seal section and an electric motor comprising a drive shaft having a bore concentric with a longitudinal axis of the drive shaft. A fluid mover disposed within and coupled to the bore of the drive shaft is configured for urging lubricating oil upward in the bore. The fluid mover includes at least one helical flighting open in the middle. The electric motor may also have a bearing coupled to the drive shaft and a bushing that is retained by a housing or by stator structure of the electric motor. The bushing defining at least one fluid flow channel extending from an upper edge of the bushing to a lower edge of the bushing and a middle portion of the fluid flow channel open to the inside surface of the bushing.

17 Claims, 6 Drawing Sheets

(58) Field of Classification Search
CPC ..... F04D 1029/057; F04D 1029/447; F04D 1029/448; F04D 1029/5806; F04D 1029/5886; H02K 5/132; F16C 33/1025; F16C 33/1045; F16C 33/106; F16C 33/1085
See application file for complete search history.

(56) References Cited

U.S. PATENT DOCUMENTS

| | | | | |
|---|---|---|---|---|
| 2013/0091878 | A1 | 4/2013 | Jankowski et al. | |
| 2019/0032459 | A1 | 1/2019 | Pires et al. | |
| 2019/0128320 | A1* | 5/2019 | Cox | F16C 33/106 |
| 2019/0186245 | A1 | 6/2019 | Bellmyer et al. | |
| 2019/0249537 | A1* | 8/2019 | Brown | E21B 43/12 |
| 2021/0036580 | A1 | 2/2021 | Cottrell | |

FOREIGN PATENT DOCUMENTS

| | | | | |
|---|---|---|---|---|
| GB | 2375375 | A * | 11/2002 | H02K 5/1672 |
| WO | 02072998 | A1 | 9/2002 | |

* cited by examiner

OIL TRANSPORT STRUCTURE IN AN ELECTRIC MOTOR OF AN ELECTRIC SUBMERSIBLE PUMP (ESP) ASSEMBLY

STATEMENT REGARDING FEDERALLY SPONSORED RESEARCH OR DEVELOPMENT

Not applicable.

CROSS-REFERENCE TO RELATED APPLICATIONS

None.

REFERENCE TO A MICROFICHE APPENDIX

Not applicable.

BACKGROUND

Electric submersible pump (ESP) assemblies may comprise an electric motor, a seal section coupled to the electric motor, a fluid inlet coupled to the seal section, and a centrifugal pump coupled to the fluid inlet. A drive shaft of the electric motor is coupled to a drive shaft of the seal section, and the drive shaft of the seal section passes through the fluid inlet and couples to a drive shaft of the centrifugal pump assembly. When the electric motor is supplied electric power from the surface, the electric motor turns the drive shaft of the electric motor. The drive shaft of the electric motor then turns the drive shaft of the seal section, and the drive shaft of the seal section turns the drive shaft of the centrifugal pump assembly. The centrifugal pump assembly may comprise one or more pump stages, where each pump stage comprises an impeller coupled to the drive shaft of the centrifugal pump assembly and a diffuser that is coupled to an outer housing of the centrifugal pump assembly. The electric motor turns, the impellers turn, reservoir fluid is draw into the fluid inlet and lifted by the one or more pump stages to the surface. Electric motors of ESP assemblies are typically turned at rates between 3450 RPM and 3650 RPM and are operated continuously. It is desirable that the ESP assemblies operate for upwards of a year continuously without maintenance to achieve production goals and manage maintenance costs. Some ESP assemblies may incorporate a gas separator assembly located between the fluid inlet and the centrifugal pump whose purpose is to separate a gas phase fluid fraction (or higher gas liquid ratio fraction) of the reservoir from a liquid phase fluid fraction (or a lower gas liquid ratio fraction) of the reservoir fluid, exhaust the gas phase fluid into an annulus formed between the inside of wellbore and the outside of the ESP assembly, and flow the liquid phase fluid to the inlet of the centrifugal pump.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
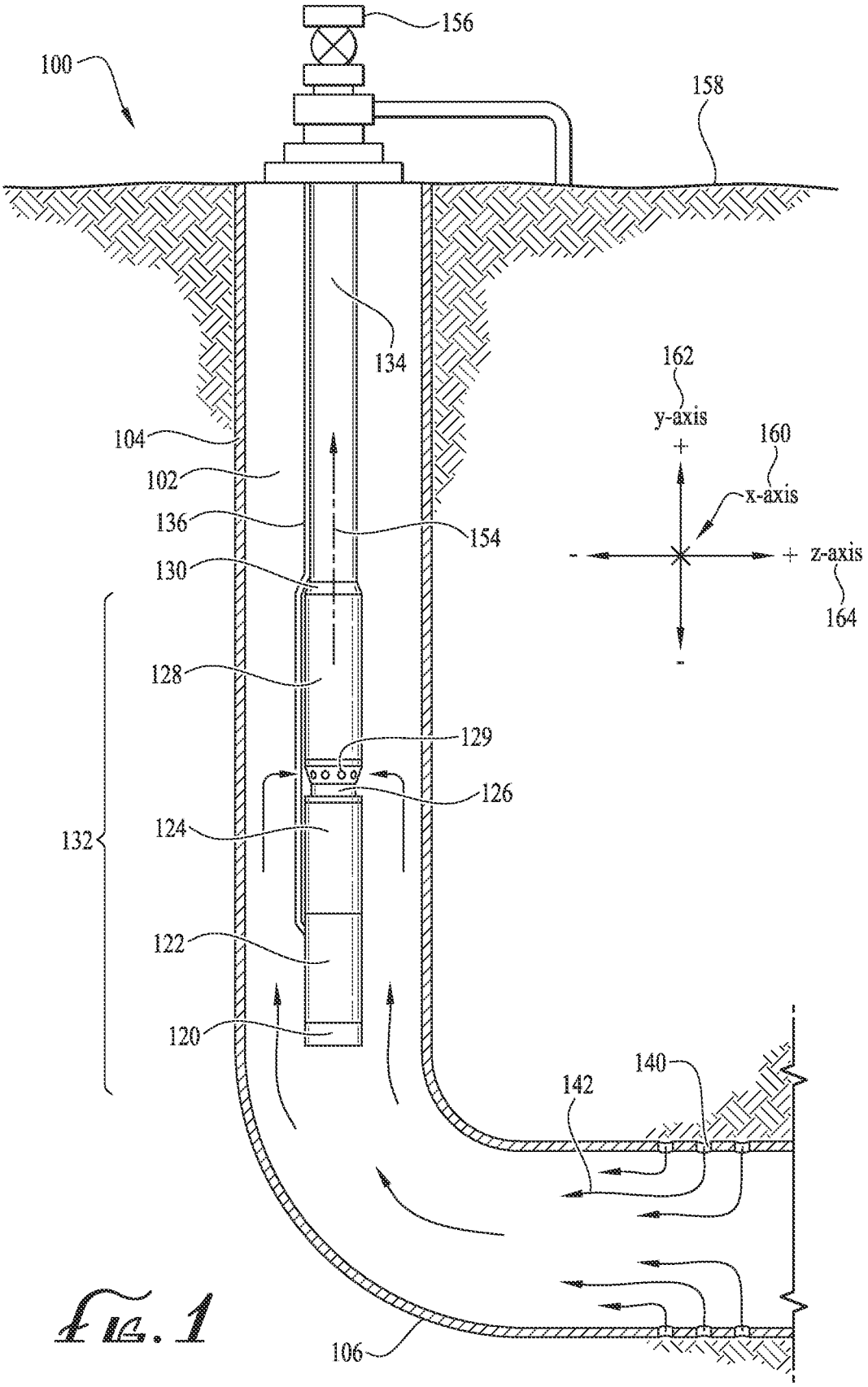
FIG. 1 is an illustration of a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

ESP assemblies operate in a challenging environment. Wellbores in some environments are tight. For example, the trend is towards drilling narrower diameter wellbores, whereby to reduce drilling costs. Tighter wellbores impose technical obstacles, including transferring heat generated by the electric motor. Heat generated by a variety of processes in the electric motor is transferred away from the heat source by a housing of the electric motor, for example to wellbore fluid surrounding the ESP assembly. Heat may be produced in the electric motor by current flow in electric motor windings and by core losses in the electric motor stator core and rotor core. Core loses can include eddy current losses and hysteresis losses. Heat may be produced in the electric motor by bearing/bushing friction, and other processes. The electric motor is located below the fluid inlet of the ESP assembly, hence wellbore fluid may flow upwards over the outside surface of the housing of the electric motor, receiving heat transferred from the housing. But heat may concentrate in an upper end of the electric motor, creating a "hot spot." Often electrical failures occur in the upper ends of electric motors, probably due to excess heat in the upper ends of the electric motors.

The present disclosure teaches new structures for moving oil within the electric motor, whereby to improve the cooling of the electric motor and/or to promote even distribution of heat within the electric motor to avoid hot spots. In an embodiment, a longitudinal bore that is concentric with a longitudinal axis of a drive shaft of the electric motor provides a flow path for circulating oil within the electric motor. In an embodiment, the longitudinal bore is a through bore, and the oil exits the upper end of the through bore and flows downwards within an interior of the electric motor on the outside of the drive shaft to re-enter the bore at the lower end of the drive shaft. In another embodiment, the longitudinal bore stops before it reaches the upper end of the drive shaft, a transverse bore taps into the longitudinal bore, and the oil flows upwards through the longitudinal bore, through the transverse bore, out of the transverse bore, and downwards within the interior of the electric motor to re-enter the bore at the lower end of the drive shaft. A fluid mover is disposed within and coupled to the longitudinal bore of the drive shaft of the electric motor. As the drive shaft of the electric motor turns, the fluid mover actively urges oil to flow upwards within the bore of the drive shaft, out of the bore, and downwards within the interior of the electric motor. This recirculation of the oil evens out the temperatures within the electric motor, reducing the concentration of high temperature in the upper end of the electric motor and avoiding hot spots more generally, thereby extending service life of the electric motor. This recirculation of the oil may also improve (e.g., increase) heat transfer away from the electric motor. In an embodiment, the oil within the electric motor is dielectric oil. Dielectric oil may have high viscosity that impedes passive oil circulation. The fluid mover disposed within the drive shaft can compensate for the reluctance of high viscosity oil to circulate within the electric motor by actively urging this circulation flow.

In an embodiment, the longitudinal bore of the drive shaft of the electric motor (a through bore in this embodiment) is in fluid communication with a corresponding second longitudinal bore in a drive shaft of a seal section of the ESP assembly. Oil urged upwards by the fluid mover disposed within the longitudinal bore of the drive shaft of the electric motor flows up into the second longitudinal bore in the drive shaft in the seal section, exits via a transverse bore in the drive shaft of the seal section that is tapped into the second longitudinal bore, and recirculates downwards within the seal section and back into the electric motor. The heat of the oil received from the electric motor, in this way, can be transferred to a housing of the seal section and improve the heat transfer away from the electric motor.

In an embodiment, the electric motor comprises at least one bushing that is retained by the housing of the electric motor. The bushing has a cylindrical shape having an inside surface in contact with an outside surface of a bearing that is coupled to the drive shaft of the electric motor. The mated combination of the bushing and the bearing (e.g., the bearing is located inside of the bushing, and the bushing and the bearing are concentric with a center axis of the drive shaft of the electric motor) stabilizes and supports the drive shaft of the electric motor. The bushing defines at least one fluid flow channel extending from an upper edge of the bushing to a lower edge of the bushing and a middle portion of the at least one fluid flow channel is open to the inside surface of the bushing. The at least one fluid flow channel promotes recirculation of the oil within the electric motor. Additionally, this middle portion of the fluid flow channel of the bushing that is open to the inside surface of the bushing may improve the lubrication and cooling function of the oil at the interface between the bushing and the bearing. In an embodiment, the upper portion of the fluid flow channel angles inwards from the upper edge of the bushing to the opening at the inside surface of the middle portion of the bushing and angles outwards from the opening at the inside surface of the middle portion of the bushing. In an embodiment, the upper portion of the fluid flow channel may angle inwards with a helical twist, whereby to impart angular momentum to the oil before it contacts the outside surface of the drive shaft of the bearing and to urge introduction of the oil between the inside surface of the bushing and the outside surface of the bearing. In some contexts, the bearing may be referred to as a rotor bearing. The electric motor may comprise two or more pairs of like bushings and mated bearings.

Turning now to FIG. 1, a wellsite 100 is described. The wellsite 100 comprises a wellbore 102 optionally lined with a casing 104, an electric submersible pump (ESP) assembly 132 in the wellbore 102, and a production tubing string 134. The ESP assembly 132 comprises an optional sensor unit 120 at a downhole end, an electric motor 122 coupled to the sensor unit 120 uphole of the sensor unit 120, a seal section 124 coupled to the electric motor 122 uphole of the electric motor 122, a fluid intake 126 coupled to the seal section 124 uphole of the seal section 124, a production pump assembly 128 coupled to the fluid intake 126 uphole of the fluid intake 126, and a pump discharge 130 coupled to the production pump assembly 128 uphole of the production pump assembly 128. The pump discharge 130 is coupled to the production tubing string 134. In an embodiment, a motor head or pot head (not shown) is coupled between the electric motor 122 and the seal section 124.

In an embodiment, the casing 104 has perforations 140 that allow reservoir fluid 142 to enter the wellbore 102 and flow downstream to the fluid intake 126. The reservoir fluid 142 enters inlet ports 129 of the fluid intake 126, flows from the fluid intake 126 into an inlet of the production pump assembly 128, is pumped by the production pump assembly 128 to flow out of the production pump assembly 128 into the pump discharge 130 up the production tubing string 134 to a wellhead 156 located at the surface 134. In an embodiment, an electric cable 136 is connected to the electric motor 122 and provides electric power from an electric power source located at the surface 158 to the electric motor 122 to cause the electric motor 122 to turn and deliver rotational power to the production pump assembly 128. In an embodiment, the electric cable 136 attaches to the electric motor 122 via a motor head or pot head. In an embodiment, the production pump assembly 128 comprises one or more centrifugal pump stages, where each centrifugal pump stage comprises an impeller coupled to a drive shaft of the production pump assembly 128 and a diffuser retained by a housing of the production pump assembly 128. The drive shaft of the production assembly is coupled to a drive shaft of the seal section 124. The drive shaft of the seal section 124 is coupled to a drive shaft of the electric motor 122. In some contexts, the production pump assembly 128 may be referred to as a centrifugal pump assembly. The production pump assembly 128 may be said to lift the reservoir fluid 154 to the surface 158.

In an embodiment, the ESP assembly 132 may further comprise a gas separator assembly, for example located between the fluid intake 126 and the production pump assembly 128. The gas separator assembly may induce rotational motion of the reservoir fluid 142 within a separation chamber such that high gas liquid ratio fluid concentrates near a drive shaft of the gas separator assembly and a low gas liquid ratio fluid concentrates near an inside housing of the gas separator assembly. The high gas liquid ratio fluid exits the gas separator by gas discharge ports to an exterior of the gas separator (e.g., into the wellbore 102 outside the ESP assembly 132), and the low gas liquid ratio fluid is flowed by liquid discharge ports to the inlet of the production pump assembly 128. In this way, the gas separator assembly may provide a lower gas liquid ratio fluid to the production pump assembly 128 when the reservoir fluid 142 comprises a mix of gas phase and liquid phase fluid. In an embodiment, the gas separator assembly may comprise one or more fluid reservoirs that define empty annular spaces that may serve as fluid reservoirs that can continue to supply at least some liquid phase fluid during an extended gas slug impinging on the fluid intake 126. The drive shaft of the gas separator assembly may be coupled to the drive shaft of the seal section 124 at a downhole end and coupled at an uphole end to the downhole end of the drive shaft of the production pump assembly 128.

In an embodiment, the ESP assembly 132 may further comprise a charge pump assembly, for example located between the fluid intake 126 and the gas separator assembly. The charge pump assembly may comprise one or more fluid movers to urge the reservoir fluid 142 upwards to the gas separator assembly. The fluid movers of the charge pump assembly may be an auger coupled to a drive shaft of the charge pump assembly. The fluid movers of the charge pump assembly may be one or more centrifugal pump stages, where each centrifugal pump stage comprises an impeller coupled to a drive shaft of the charge pump assembly and a diffuser retained by a housing of the charge pump assembly. In an embodiment, the charge pump assembly may comprise one or more fluid reservoirs that define empty annular spaces that may serve as fluid reservoirs that can continue to supply at least some liquid phase fluid to the gas separator assembly during an extended gas slug impinging on the fluid intake 126. The drive shaft of the charge pump assembly may be coupled at a downhole end to the drive shaft of the seal section 124 and coupled at an uphole end to the downhole end of the drive shaft of the gas separator assembly.

An orientation of the wellbore 102 and the ESP assembly 132 is illustrated in FIG. 1 by an x-axis 160, a y-axis 162, and a z-axis 164. While the wellbore 102 is illustrated in FIG. 1 as having a deviated portion or a substantially horizontal portion 106, the ESP assembly 132 may be used in a substantially vertical wellbore 102. While the wellsite 100 is illustrated as being on-shore, the ESP assembly 132 may be used in an off-shore location as well.

Figure 2A:
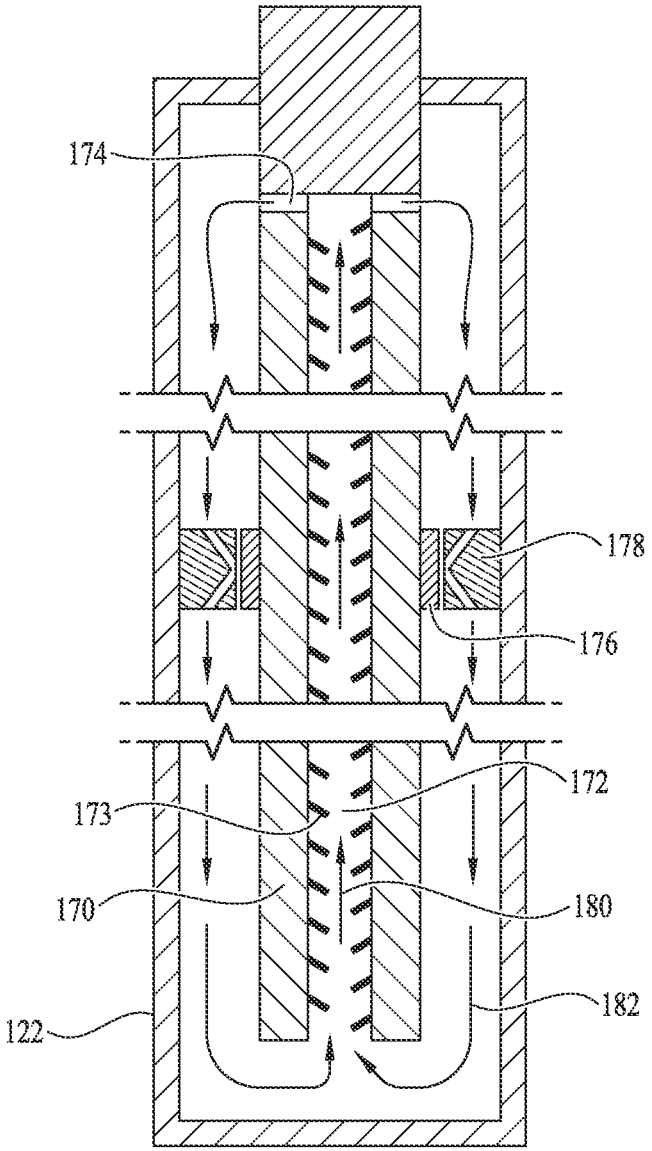
FIG. 2A is an illustration of an electric motor according to an embodiment of the disclosure.

Turning now to FIG. 2A, further details of the electric motor 122 are described. It is understood that many details of the electric motor 122 are not included in FIG. 2A, whereby to focus attention better on the novel features taught herein. In an embodiment, the electric motor 122 is a three-phase alternating current motor. In an embodiment, the electric motor 122 is a squirrel cage induction-type asynchronous type electric motor. In another embodiment, however, a different form of electric motor may be used, for example a synchronous permanent magnet motor using permanent magnets in the rotor.

The electric motor 122 comprises a drive shaft 170 that has a longitudinal bore 172 that extends at least partially along the longitudinal axis of the drive shaft 170. In an embodiment, the bore 172 extends completely through the drive shaft 170 and is a through bore. In an embodiment, a transverse bore 174 taps into the bore 172 such that a first end of the transverse bore 174 is open to the interior of the bore 172 and a second end of the transverse bore 174 is open to an interior of the electric motor 122 outside of the drive shaft 170. A fluid mover 173 is disposed within the bore 172 such that as the drive shaft 170 rotates, the fluid mover 173 urges oil to flow upwards within the bore 172 and to exit the bore 172 via the transverse bore 174 into the interior of the electric motor 122 outside of the drive shaft 170. The electric motor comprises at least one bearing 176 and associated bushing 178. The bearing 176 is coupled to the drive shaft 170 and rotates with the drive shaft 170. The bushing 178 is retained by a housing of the electric motor 122 or by other structure within the electric motor 122 (e.g., stator structure).

In an embodiment, the bushing 178 defines interior channels to promote flow of the oil from an uphole side of the bushing 178 to the downhole side of the bushing 178. An upper portion of the interior channel opens to an interior surface of the bushing 178 whereby to supply lubricating oil to the interface between the outside surface of the bearing 176 and the inside surface of the bushing 178. A lower portion of the interior channel leads from the opening in the interior surface of the bushing 178 to the downhole side of the bushing 178. Further details of the bushing 178 and bearing 176 are discussed below with reference to FIG. 3A, FIG. 3B, and FIG. 3C.

Figure 2B:
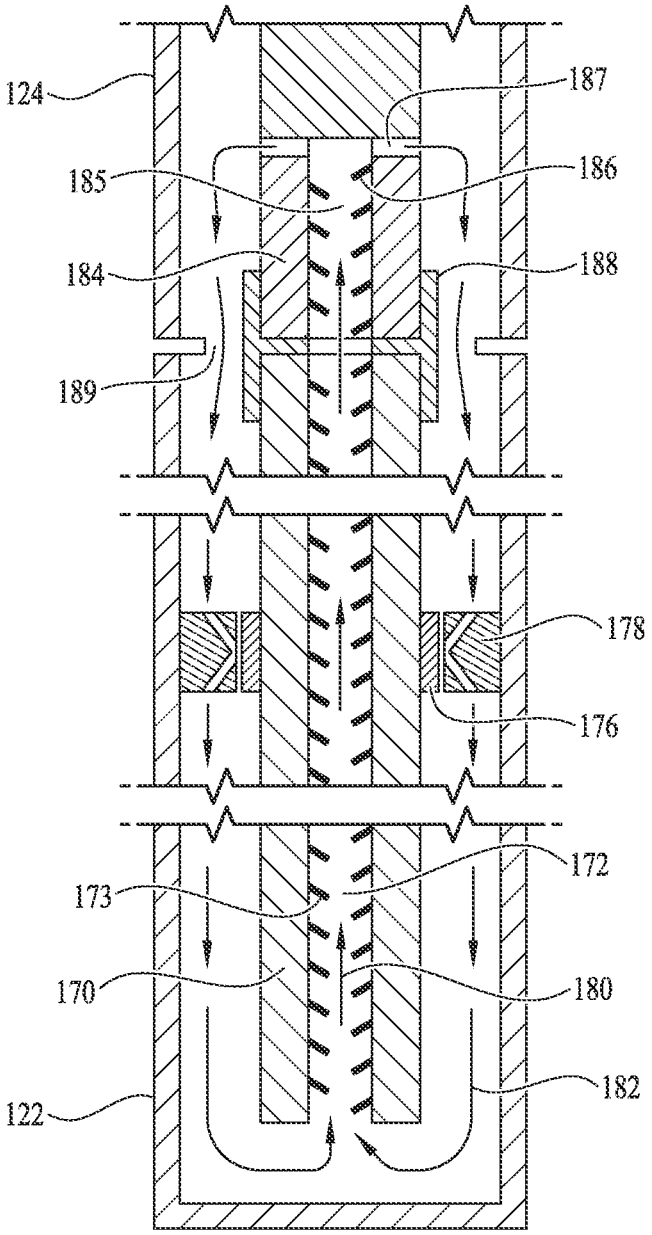
FIG. 2B is an illustration of an electric motor and seal section according to an embodiment of the disclosure.

The longitudinal bore 172, the transverse bore 174, and the interior channels of the bushing 178 define a circuit for oil flow within the electric motor 122. The circulation of oil around this circuit urged by the fluid mover 173 promotes heat transfer within the electric motor 122 and avoids the development of hot spots within the electric motor 122 that otherwise makes those hot spots a primary failure point of the electric motor 122. The circulation of oil around this circuit urged by the fluid mover 173 may further promote heat transfer out of the electric motor 122, for example to reservoir fluid 142 in the wellbore 102 and/or into the seal section 124 as discussed further with reference to FIG. 2B below.

The fluid mover 173 may be a helical flighting that is installed within the bore 172. The helical fighting may not have a central spine or pole and may be open in the middle, like a spiral staircase with an open shaft in the center. The fluid mover 173 may extend the full length of the bore 172. Alternatively, in an embodiment, the fluid mover 173 may not have the same length as the longitudinal bore 172 as illustrated in FIG. 2A but may be shorter and extend only a portion of the length of the longitudinal bore 172. In an embodiment, the fluid mover 173 may be located at the lower opening of the longitudinal bore 172. In an embodiment, the fluid mover 173 may comprise multiple separate pieces which are positioned at different points within the longitudinal bore 172. These multiple separate pieces of the fluid mover 173 may each comprise a helical flighting. These multiple separate pieces of the fluid mover 173 may be said to be placed at intervals along the inside of the longitudinal bore 172.

The helical flighting may be twisted in one direction during assembly, whereby to reduce its outside diameter and assist in inserting the helical flighting into the bore 172. Once in place, the twisting stress on the helical flighting can be released, and the helical flighting will expand to fit tightly within the bore 172. Alternatively, the helical flighting may be inserted into the bore 172 and secured in a keyway in the uphole end of the bore 172 and secured by a pin or other attachment hardware at a downhole end of the bore 172. The helical flighting may have a central spine or pole and may be similar to an auger in shape. In an embodiment, the fluid mover 173 may be an auger. In an embodiment, the fluid mover 173 may be provided by one or more paddle wheels inserted into the bore 172 and coupled to the drive shaft 170.

Turning now to 2B, an alternative configuration of the electric motor 122 and seal section 124 is described. In an embodiment, the longitudinal bore 172 continues completely through the drive shaft 170 of the electric motor 122 and mates with a longitudinal bore 185 in a drive shaft 184 of the seal section 124. A transverse bore 187 in the drive shaft 184 taps into the longitudinal bore 185. The drive shaft 184 of the seal section 124 is coupled to the drive shaft 170 of the electric motor 122 by a coupling sleeve 188. For example, the ends of the drive shafts 170, 184 may feature male splines, and the interior of the coupling sleeve 188 may define female splines that mate with the male splines on the ends of the drive shafts 170, 184. In this alternative configuration, the transverse bore 174 described above with reference to FIG. 2A may not be present in the drive shaft 170.

The longitudinal bore 172, the longitudinal bore 185, the transverse bore 187, the interior of the seal section 124 outside of the drive shaft 184, the oil communication port between the seal section 124 and the electric motor 122, and the interior of the electric motor 122 outside of the drive shaft 170 define a circuit for oil flow within the seal section 124 and the electric motor 122. The circulation of oil around this circuit urged by the fluid mover 173 promotes heat transfer within the electric motor 122 to avoid the development of hot spots within the electric motor 122. The circulation of oil out of the electric motor 122 into the seal section 124 and back to the electric motor 122 via flow 189 across the oil communication port between the seal section 124 and the electric motor 122 further promotes heat transfer out of the electric motor 122, to the seal section 124, and out via a housing of the seal section 124 to the wellbore 102 (e.g., to reservoir fluid 142 flowing over the exterior of the electric motor 122 and over the exterior of the seal section 124). Because the seal section 124 does not itself produce much heat, because there are not high electric current flows through windings and no core losses in the seal section 124 and only low heat generated by friction between bearings and bushings in the seal section 124, this alternative configuration provides means for significant improvement in heat transfer out of the electric motor 122 and out into the wellbore (e.g., to the reservoir fluid 142).

In an embodiment, the longitudinal bore 185 may receive a fluid mover 186 similar to the fluid mover 172 of the bore 172 described above with reference to FIG. 2A. The fluid mover 186 may extend the full length of the bore 185. Alternatively, the fluid mover 186 may extend only part of the length of the bore 185. The fluid mover 186 may be provided in multiple components and be placed at intervals along the longitudinal bore 185.

In different embodiments, the length of the longitudinal bore 185 within the drive shaft 184 may be different. During design and/or manufacturing, based on the expected wellsite 100 and/or production flow rate, a longer or shorter length of bore 185 may be selected. For example, an assembly depot or manufacturing plant may stock different versions of the drive shaft 184 having a short length of bore 185, having a medium length of bore 185, and having a long length of bore 185. If a higher rate of production is expected or if a higher pump head (e.g., for a deeper wellbore 102) is needed, a longer length of bore 185 may be employed in anticipation of relatively higher current loads within the electric motor 122 and a consequent need for greater heat dissipation. If a lower rate of production is expected or if a lower pump head is needed, a shorter length of bore 185 may be employed in anticipation of relatively lower current loads within the electric motor 122 and a consequent lesser need for heat dissipation.

Figure 3A:
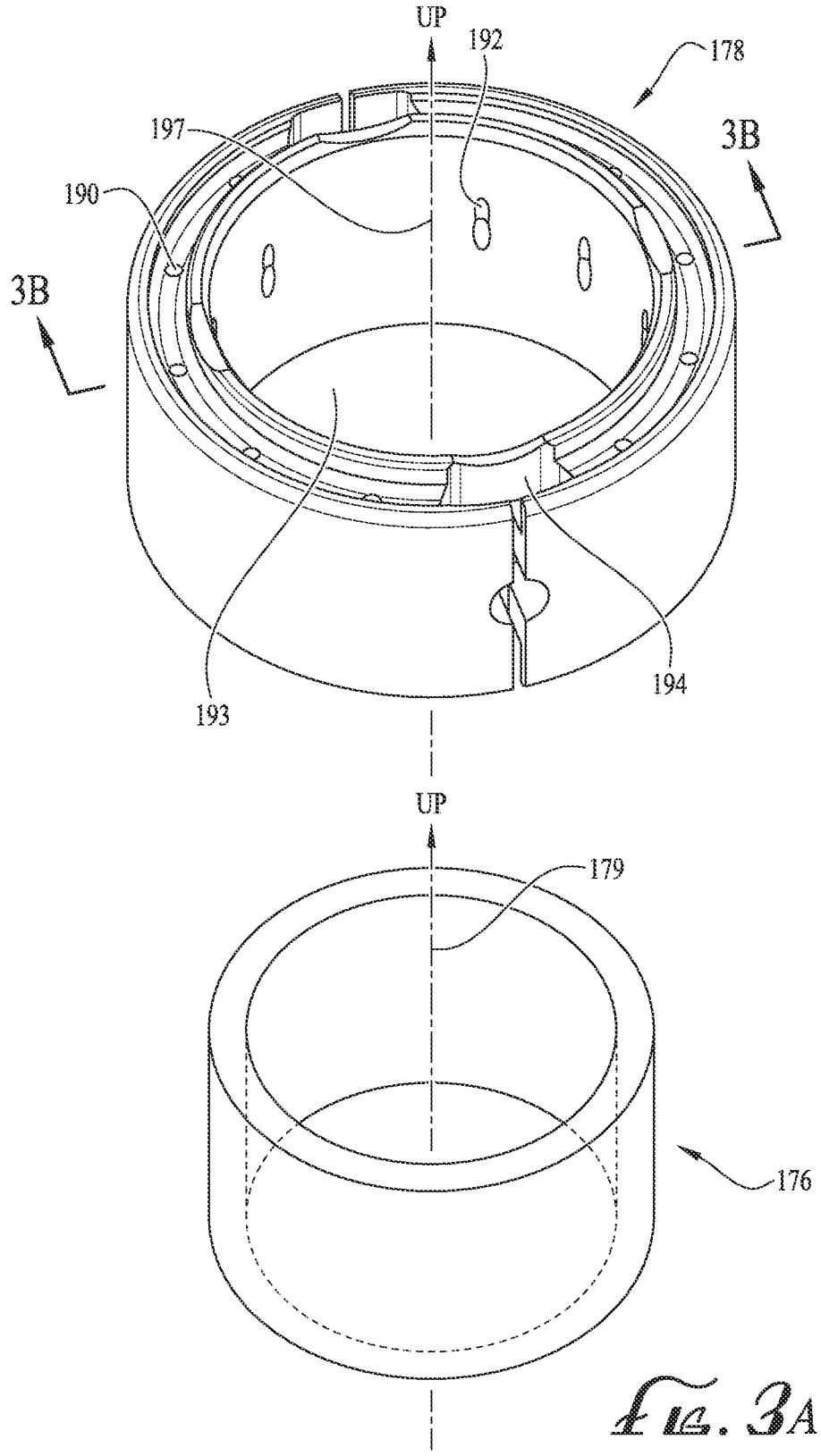
FIG. 3A is an illustration of a bearing and bushing according to an embodiment of the disclosure.
Figure 3B:
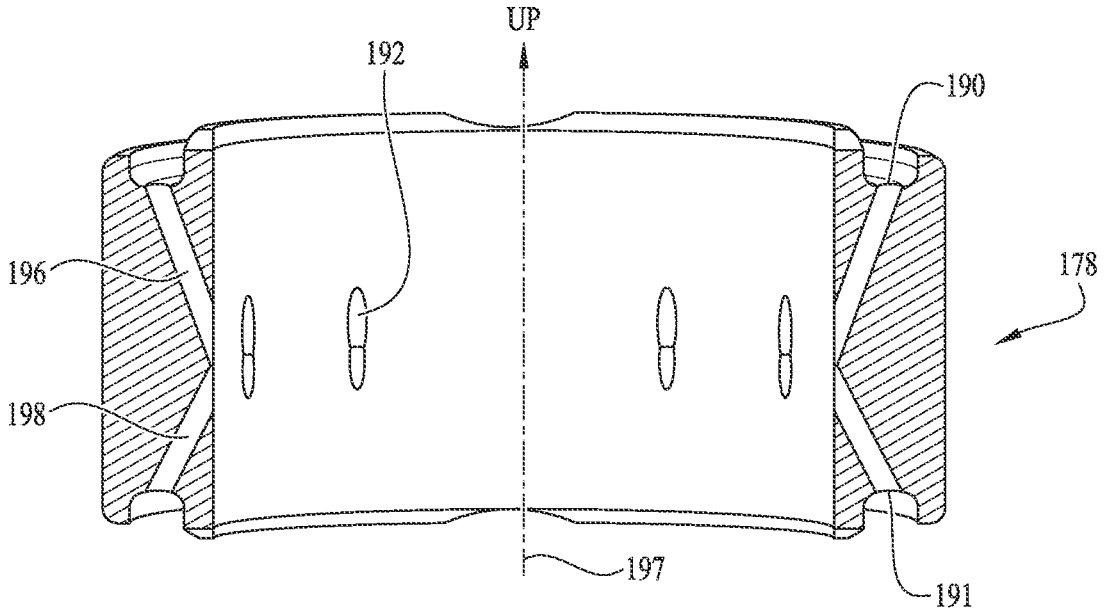
FIG. 3B is an illustration showing further details of the bushing of FIG. 3A according to an embodiment of the disclosure.
Figure 3C:
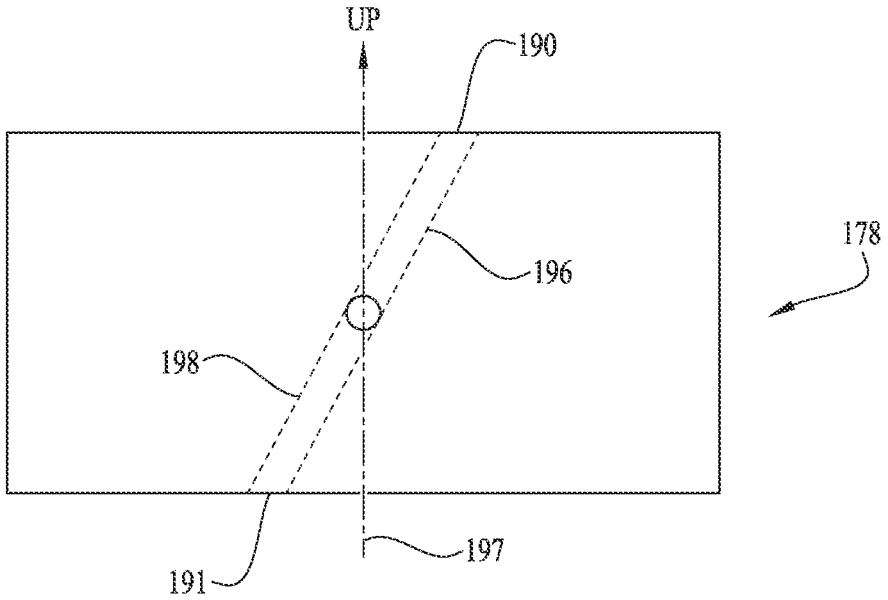
FIG. 3C is an illustration showing an alternative embodiment of the bushing of FIG. 3A and FIG. 3B according to an embodiment of the disclosure.

Turning now to FIG. 3A, FIG. 38, and FIG. 3C, further details of the bearing 176 and the busing 178 are described. The bearing 176 is a cylindrical shaped metal part that has a longitudinal axis 179. The bearing 176 may be made of a variety of different materials. The bearing 176 may be made of metal. The bearing 176 may be made of non-magnetic metal.

The bushing 178 is generally cylindrical in shape with an opening 193 and has a longitudinal axis 197. When the drive shaft 170 of the electric motor 122, the bearing 176, and the bushing 178 are installed in the electric motor 122, the longitudinal axis of the drive shaft 170, the longitudinal axis 179 of the bearing 176, and the longitudinal axis 197 of the bushing 178 are substantially coincident. The upper lip of the bushing 178 comprises a plurality of oil entrance ports 190. The entrance ports 190 form the entrance to an upper channel 196 that opens at a lower end to a central opening 192 on an inside surface of the bushing 178. The lower lip of the bushing 178 comprises a plurality of oil exit ports 191. The exit ports 191 form the exit of a lower channel 198 that opens at an upper end to the central opening 192. In an embodiment, the bushing 178 comprises a keyway 194 that may be used to install a spring-loaded key that can secure and/or retain the bushing 178 within the housing of the electric motor 122 or other structure (e.g., stator structures) within the electric motor 122. The bushing 178 may be made of non-magnetic metal.

In operation, the oil within the electric motor 122 flows downwards outside the drive shaft 170 within the electric motor 122 through the entrance ports 190, through the upper channels 196 to the central openings 192. The oil may flow partially into the region between the outside of the bearing 176 and the inside of the bushing 178 to provide lubrication and an oil film at the interface between the bearing 176 and bushing 178. The oil may flow down the lower channels 198 and out the exit ports 191. The oil may continue to flow downwards outside the drive shaft 170 within the electric motor 122 to be drawing back into the bore 172 of the drive shaft 170 by the fluid mover 173.

It is understood that the electric motor 122 may comprise any number of bearing 176 and bushing 178 pairs. In an embodiment where the drive shaft 184 of the seal section 124 has a bore 185, the seal section 124 may comprise one or more sets of bearing 176 and bushing 178 pairs in the region below the transverse bore 187.

With reference now to FIG. 3C, in an embodiment, the upper channel 196 and the lower channel 198 may pass downwards through the cylindrical wall of the bushing 178 in a diagonal sense. Because the bushing 178 is curved, the shape of the channels 196, 198 become at least partially helical in trajectory. It is contemplated that the diagonal trajectory or partially helical trajectory of the upper channel 196 may impart a partially rotating momentum into the oil as it flows in the upper channel 196 such that as it arrives at the central openings 192 the oil is urged into the space between the outside of the bearing 176 and the inside of the bushing 178. In an embodiment, the direction of slant of the upper channel 196 may be oriented in the same direction as the direction of rotation of the drive shaft 170 and or the bearing 176.

Figure 4:
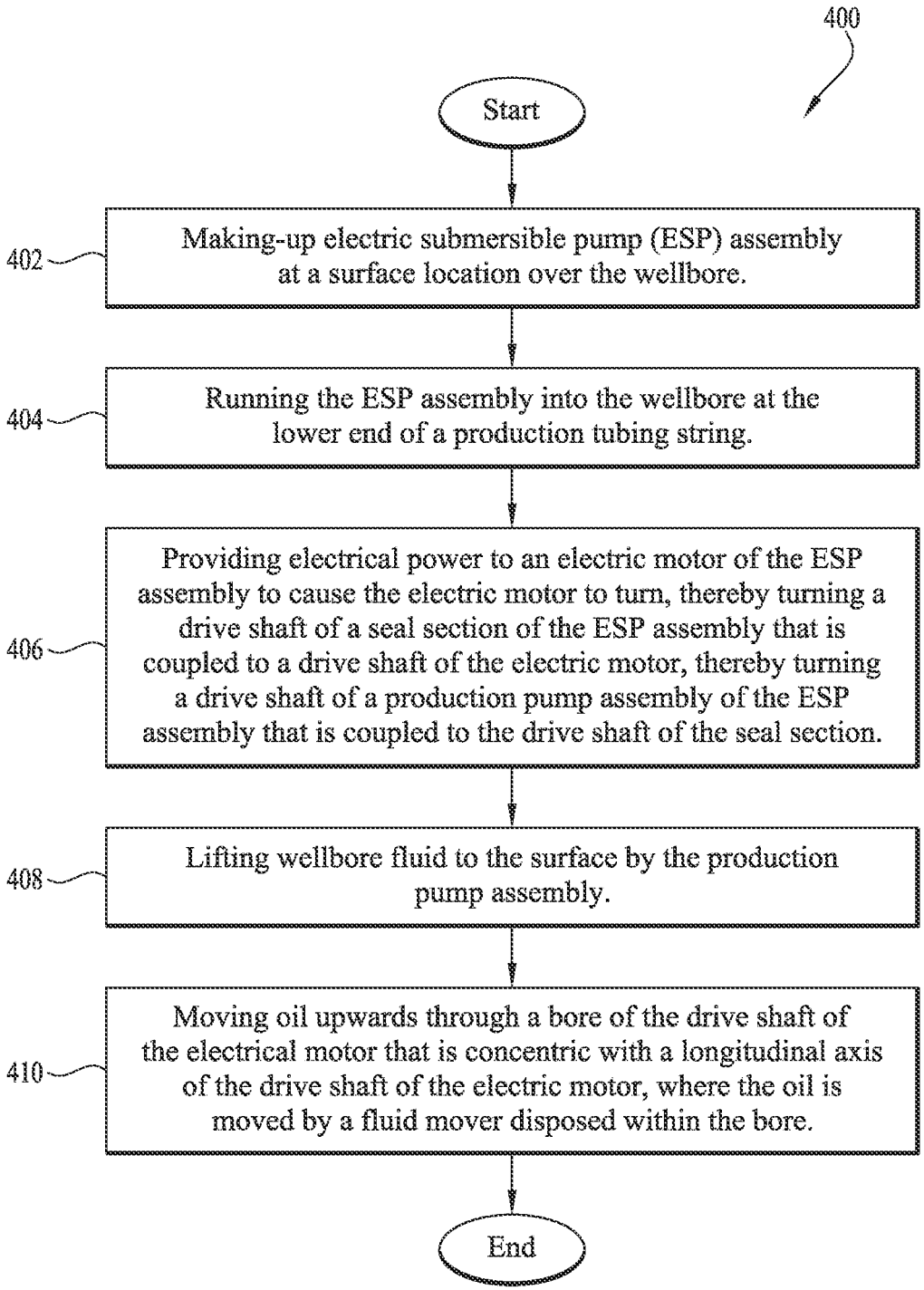
FIG. 4 is a flow chart of a method according to an embodiment of the disclosure.

Turning now to FIG. 4, a method 400 is described. In an embodiment, the method 400 is a method of lifting wellbore fluid to a surface. In an embodiment, at least parts of the method 400 may be performed by the ESP assembly 132 described above with reference to FIG. 1, FIG. 2A, FIG. 2B, FIG. 3A, FIG. 3B, and FIG. 3C. At block 402, the method 400 comprises making-up an electric submersible pump (ESP) assembly at a surface location over the wellbore. Making-up the ESP assembly may comprise coupling together the components of the ESP assembly and coupling together drive shafts of components of the ESP assembly.

Making up the ESP assembly may comprise topping up oil in the electric motor 122 and/or in the seal section 124. Making up the ESP assembly may comprise attaching a connector of the electric power cable 136 to the electric motor 122 and/or to a motor head or pot head of the ESP assembly 132.

At block 404, the method 400 comprises running the ESP assembly into the wellbore at the lower end of a production tubing string. Running in the ESP assembly into the wellbore may comprise adding joints of production tubing to the production tubing string 134 to progressively extend the ESP assembly 132 down into the wellbore 102, for example suspended in the wellbore 102 from a drilling rig located over the wellbore 102. At block 406, the method 400 comprises providing electrical power to an electric motor of the ESP assembly to cause the electric motor to turn, thereby turning a drive shaft of a seal section of the ESP assembly that is coupled to a drive shaft of the electric motor, thereby turning a drive shaft of a production pump assembly of the ESP assembly that is coupled to the drive shaft of the seal section. In an embodiment, the ESP assembly may comprise a gas separator assembly located downstream of the production pump assembly, and turning the drive shaft of the seal section may turn the drive shaft of the gas separator assembly, and turning the drive shaft of the gas separator assembly may turn the drive shaft of the production pump assembly. At block 408 the method 400 comprises lifting wellbore fluid to the surface by the production pump assembly. When the ESP assembly comprises a gas separator assembly, the processing of block 408 may comprise separating a high gas fluid ratio fluid from a low gas fluid ratio fluid by the gas separator assembly, exhausting the high gas fluid ration fluid out gas discharge ports, and flowing low gas fluid ratio fluid by the gas separator assembly to an intake of the production pump assembly.

At block 410, the method 400 comprises moving oil upwards through a bore (e.g., the longitudinal bore 172) of the drive shaft of the electric motor that is concentric with a longitudinal axis of the drive shaft of the electric motor, where the oil is moved by a fluid mover disposed within the bore. In an embodiment, the fluid mover (e.g., fluid mover 173) may comprise a plurality of components placed at intervals within the longitudinal bore 172. The oil may recirculate downwards within an interior of the electric motor to re-enter the bore at a lower end of the drive shaft of the electric motor. By recirculating the oil in this way, a temperature within the electric motor may be equalized. Said in other words, the recirculation of the oil in this way may reduce temperature differences within the electric motor, thereby reducing premature wear and/or damage to parts of the electric motor, for example slowing breakdown of dielectric properties of the oil and slowing breakdown of insulation of wire in windings of the electric motor.

The processing of block 410 may comprise flowing the oil out of the bore (e.g., longitudinal bore 172) into a transverse bore of the drive shaft (e.g., transverse bore 174), flowing the oil out of the transverse bore into an interior of the electric motor outside of the drive shaft of the electric motor, and flowing the oil downwards within the interior of the electric motor back to an entrance in the bore of the drive shaft of the electric motor. The processing of block 410 may comprise flowing the oil downwards through a plurality of flow channels of a bushing of the electric motor, wherein the bushing supports a bearing coupled to the drive shaft of the electric motor, for example, flowing the oil via the plurality of flow channels of the bushing through openings in an interior surface of the bushing to a space between an outside surface of the bearing and the interior surface of the bushing. In an embodiment, the oil is dielectric oil.

ADDITIONAL EMBODIMENTS

The following are non-limiting, specific embodiments in accordance with the present disclosure.

A first embodiment, which is an electric submersible pump (ESP) assembly comprising a production pump assembly; a seal section; and an electric motor comprising a drive shaft having a bore concentric with a longitudinal axis of the drive shaft and a fluid mover disposed within and coupled to the bore of the drive shaft. The bore concentric with the longitudinal axis of the drive shaft may be referred to as a longitudinal bore.

A second embodiment, which is ESP assembly of the first embodiment, wherein the fluid mover disposed within the bore of the drive shaft of the electric motor is a helical flighting.

A third embodiment, which is the ESP assembly of the first embodiment, wherein the fluid mover disposed within the bore of the drive shaft of the electric motor is an auger.

A fourth embodiment, which is the ESP assembly of any of the first through the third embodiments, wherein the fluid mover comprises a plurality of components placed at intervals within the bore.

A fifth embodiment, which is the ESP assembly of any of the first through the fourth embodiments, wherein the drive shaft has a transverse bore that taps into the bore that is concentric with the longitudinal axis of the drive shaft.

A sixth embodiment, which is the ESP assembly of any of the first through the fifth embodiments, wherein the bore of the drive shaft of the electric motor is a through bore, wherein the seal section comprises a second drive shaft having a second bore concentric with a longitudinal axis of the second drive shaft, the second drive shaft is mechanically coupled to the drive shaft of the electric motor, and the second bore of the second drive shaft is in fluid communication with the though bore of the drive shaft of the electric motor. The second bore may be referred to as a second longitudinal bore.

A seventh embodiment, which is the ESP assembly of the sixth embodiment, wherein the seal section further comprises a second fluid mover that is disposed within and coupled to the second bore.

An eighth embodiment, which is the ESP assembly of the seventh embodiment, wherein the second drive shaft has a transverse bore that taps into the second bore of the second drive shaft that is concentric with the longitudinal axis of the second drive shaft.

A ninth embodiment, which is the ESP assembly of any of the first through the eighth embodiments, wherein the electric motor comprises a bearing coupled to the drive shaft and a bushing having a cylindrical shape, wherein an inside surface of the bushing is in contact with an outside surface of the bearing and an outside surface of the bushing is retained by a housing of the electric motor or by a stator structure of the electric motor, and wherein the bushing defines at least one fluid flow channel extending from an upper edge of the bushing to a lower edge of the bushing and a middle portion of the at least one fluid flow channel is open to the inside surface of the bushing.

A tenth embodiment, which is the ESP assembly of any of the first through the ninth embodiments, further comprising a gas separator assembly having a drive shaft coupled to a drive shaft of the seal section and coupled to a drive shaft of the production pump assembly.

An eleventh embodiment, which is the ESP assembly of the tenth embodiment, further comprising a charge pump assembly having a drive shaft coupled to a drive shaft of the seal section and coupled to a drive shaft of the gas separator assembly.

A twelfth embodiment, which is an electric submersible pump (ESP) assembly comprising a production pump assembly; a seal section; and an electric motor comprising a drive shaft, a bearing coupled to the drive shaft; and a bushing having a cylindrical shape, wherein an inside surface of the bushing is in contact with an outside surface of the bearing and an outside surface of the bushing is retained by a housing of the electric motor or by a stator structure of the electric motor, and wherein the bushing defines at least one fluid flow channel extending from an upper edge of the bushing to a lower edge of the bushing and a middle portion of the at least one fluid flow channel is open to the inside surface of the bushing.

A thirteenth embodiment, which is the ESP assembly of the twelfth embodiment, wherein the bearing and the bushing comprise non-magnetic metal material.

A fourteenth embodiment, which is the ESP assembly of the twelfth or thirteenth embodiments, wherein the at least one fluid flow channel has an upper portion leading from the upper edge of the bushing to the middle portion that is open to the inside surface of the bearing, wherein the upper portion of the at least one fluid flow channel is helical in shape.

A fifteenth embodiment, which is the ESP assembly of any of the twelfth through the fourteenth embodiments, wherein the bushing has at least one keyway for retaining a spring-loaded key.

A sixteenth embodiment, which is a method of lifting wellbore fluid to a surface comprising making-up an electric submersible pump (ESP) assembly at a surface location over the wellbore; running the ESP assembly into the wellbore at the lower end of a production tubing string; providing electrical power to an electric motor of the ESP assembly to cause the electric motor to turn, thereby turning a drive shaft of a seal section of the ESP assembly that is coupled to a drive shaft of the electric motor, thereby turning a drive shaft of a production pump assembly of the ESP assembly that is coupled to the drive shaft of the seal section; lifting wellbore fluid to the surface by the production pump assembly; and moving oil upwards in a bore of the drive shaft of the electric motor that is concentric with a longitudinal axis of the drive shaft of the electric motor, where the oil is moved by a fluid mover disposed within the bore. The oil may be a dielectric oil. The bore of the drive shaft may be a longitudinal bore.

A seventeenth embodiment, which is the method of the sixteenth embodiment, further comprising flowing the oil out of the bore into a transverse bore of the drive shaft, flowing the oil out of the transverse bore into an interior of the electric motor outside of the drive shaft of the electric motor, and flowing the oil downwards within the interior of the electric motor back to an entrance in the bore of the drive shaft of the electric motor.

An eighteenth embodiment, which is method of either the sixteenth or the seventeenth embodiment, further comprising equalizing temperatures in the interior of the electric motor by the circulation of the oil.

A nineteenth embodiment, which is the method of any of the sixteenth through the eighteenth embodiment, further comprising flowing the oil downwards through a plurality of flow channels of a bushing of the electric motor, wherein the bushing supports a bearing coupled to the drive shaft of the electric motor.

A twentieth embodiment, which is the method of the nineteenth embodiment, further comprising flowing the oil via the plurality of flow channels of the bushing through openings in an interior surface of the bushing to a space between an outside surface of the bearing and the interior surface of the bushing.

A twenty-first embodiment, which is the method of either the nineteenth or the twentieth embodiment, wherein the bushing and the bearing comprise non-magnetic metal.

A twenty-second embodiment, which is the method of any of the sixteenth through the twenty-first embodiment, wherein the fluid mover is helical flighting.

A twenty-third embodiment, which is the method of any of the sixteenth through the twenty-second embodiment, wherein the fluid mover comprises a plurality of components placed at intervals within the bore.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

a production pump assembly;

a seal section; and an electric motor comprising a drive shaft having a bore concentric with a longitudinal axis of the drive shaft and a fluid mover disposed within and coupled to the bore of the drive shaft, wherein the fluid mover comprises a helical flighting open in the middle.

2. The ESP assembly of claim 1, wherein the drive shaft has a transverse bore that taps into the bore that is concentric with the longitudinal axis of the drive shaft.

3. The ESP assembly of claim 1, wherein the bore of the drive shaft of the electric motor is a through bore, wherein the seal section comprises a second drive shaft having a second bore concentric with a longitudinal axis of the second drive shaft, the second drive shaft is mechanically coupled to the drive shaft of the electric motor, and the second bore of the second drive shaft is in fluid communication with the though bore of the drive shaft of the electric motor.

4. The ESP assembly of claim 3, wherein the seal section further comprises a second fluid mover that is disposed within and coupled to the second bore.

5. The ESP assembly of claim 4, wherein the second drive shaft has a transverse bore that taps into the second bore of the second drive shaft that is concentric with the longitudinal axis of the second drive shaft.

6. The ESP assembly of claim 1, wherein the electric motor comprises a bearing coupled to the drive shaft and a bushing having a cylindrical shape, wherein an inside surface of the bushing is in contact with an outside surface of the bearing and an outside surface of the bushing is retained by a housing of the electric motor or by a stator structure of the electric motor, and wherein the bushing defines at least one fluid flow channel extending from an upper edge of the bushing to a lower edge of the bushing and a middle portion of the at least one fluid flow channel is open to the inside surface of the bushing.

7. The ESP assembly of claim 6, wherein the bearing and the bushing comprise non-magnetic metal material.

8. The ESP assembly of claim 6, wherein the at least one fluid flow channel has an upper portion leading from the upper edge of the bushing to the middle portion that is open to the inside surface of the bearing, wherein the upper portion of the at least one fluid flow channel is helical in shape.

9. The ESP assembly of claim 6, wherein the bushing has at least one keyway for retaining a spring-loaded key.

10. The ESP assembly of claim 1, further comprising a gas separator assembly having a drive shaft coupled to a drive shaft of the seal section and coupled to a drive shaft of the production pump assembly.

11. The ESP assembly of claim 1, wherein the helical flighting comprises a plurality of separate helical flightings, wherein each helical fighting is open in the middle.

12. A method of lifting wellbore fluid to a surface, comprising:

making-up an electric submersible pump (ESP) assembly at a surface location over the wellbore;

running the ESP assembly into the wellbore at the lower end of a production tubing string;

providing electrical power to an electric motor of the ESP assembly to cause the electric motor to turn, thereby turning a drive shaft of a seal section of the ESP assembly that is coupled to a drive shaft of the electric motor, thereby turning a drive shaft of a production pump assembly of the ESP assembly that is coupled to the drive shaft of the seal section;

lifting wellbore fluid to the surface by the production pump assembly; and moving oil upwards in a bore of the drive shaft of the electric motor that is concentric with a longitudinal axis of the drive shaft of the electric motor, where the oil is moved by a fluid mover disposed within and coupled to the bore, wherein the fluid mover comprises a helical flighting open in the middle.

13. The method of claim 12, further comprising flowing the oil out of the bore into a transverse bore of the drive shaft, flowing the oil out of the transverse bore into an interior of the electric motor outside of the drive shaft of the electric motor, and flowing the oil downwards within the interior of the electric motor back to an entrance in the bore of the drive shaft of the electric motor.

14. The method of claim 13, further comprising equalizing temperatures in the interior of the electric motor by the circulation of the oil.

15. The method of claim 13, further comprising flowing the oil downwards through a plurality of flow channels of a bushing of the electric motor, wherein the bushing supports a bearing coupled to the drive shaft of the electric motor.

16. The method of claim 15, further comprising flowing the oil via the plurality of flow channels of the bushing through openings in an interior surface of the bushing to a space between an outside surface of the bearing and the interior surface of the bushing.

17. The method of claim 15, wherein the bushing and the bearing comprise non-magnetic metal.

* * * * *